US011927416B2

(12) United States Patent
Sanders

(10) Patent No.: US 11,927,416 B2
(45) Date of Patent: Mar. 12, 2024

(54) RIFLE COVER

(71) Applicant: Steeldriver Engineering, Seneca, SC (US)

(72) Inventor: Daniel Sanders, Seneca, SC (US)

(73) Assignee: Steeldriver Engineering, Seneca, SC (US)

( * ) Notice: Subject to any disclaimer, the term of this patent is extended or adjusted under 35 U.S.C. 154(b) by 0 days.

(21) Appl. No.: 17/879,988

(22) Filed: Aug. 3, 2022

(65) Prior Publication Data

US 2024/0044605 A1 Feb. 8, 2024

(51) Int. Cl.
*F41A 35/02* (2006.01)
*F41C 23/02* (2006.01)

(52) U.S. Cl.
CPC ..... *F41A 35/02* (2013.01); *F41C 23/02* (2013.01)

(58) Field of Classification Search
CPC ..... F41C 23/02; F41C 23/16; F41A 35/02
See application file for complete search history.

(56) References Cited

U.S. PATENT DOCUMENTS

RE32,752 E 9/1988 Kiang
D623,253 S * 9/2010 Hoffman ..... F41C 23/16 D22/108
7,823,312 B2 * 11/2010 Faifer ..... F41C 23/16 42/71.01
8,104,215 B2 1/2012 Lauer
8,127,480 B1 * 3/2012 McManus ..... F41A 9/61 42/49.02
8,307,577 B2 11/2012 Baxter
8,533,987 B2 * 9/2013 Rogers ..... F41C 23/16 42/72
8,857,094 B2 10/2014 Michel
D725,218 S * 3/2015 Iosilevsky ..... D22/108
9,086,253 B2 * 7/2015 Oh ..... F41C 27/00
9,207,041 B1 12/2015 Bast
9,581,404 B2 2/2017 Lyon
9,612,075 B1 4/2017 Stephens, IV
10,386,139 B1 * 8/2019 Sharps ..... F41A 17/38
11,353,284 B2 * 6/2022 Hall ..... F41A 3/66
2010/0154275 A1 * 6/2010 Faifer ..... F41C 23/16 29/592
2012/0167431 A1 * 7/2012 Rogers ..... F41C 23/16 42/72

(Continued)

FOREIGN PATENT DOCUMENTS

EA 034492 B1 2/2020

OTHER PUBLICATIONS

Areuv, "F magwell sling clip", 2014, HKPro, all posts, <https://www.hkpro.com/threads/f-magwell-sling-clip. 194746/>. (Year: 2014).*

*Primary Examiner* — Jonathan C Weber
(74) *Attorney, Agent, or Firm* — Maier & Maier, PLLC

(57) ABSTRACT

An exemplary embodiment may include a cover which can be secured to an item such as a firearm. The cover may be placed over the lower receiver of a rifle. The cover may connect to and snap over the lower receiver in order to provide protection from outside forces or debris. In some embodiments the cover may include a magnet that can magnetically attach to a metal firearm. In another exemplary embodiment, a cover may be formed from a strap that can wrap around a portion of a firearm and elastically grip over the lower receiver.

7 Claims, 4 Drawing Sheets

(56) References Cited

U.S. PATENT DOCUMENTS

| | | | | |
|---|---|---|---|---|
| 2013/0180143 | A1* | 7/2013 | Delgado Acarreta ... | F41A 11/02 42/49.01 |
| 2021/0372733 | A1* | 12/2021 | Hall ..... | F41A 3/66 |
| 2022/0107154 | A1* | 4/2022 | Klein ..... | F41C 23/16 |
| 2022/0136788 | A1 | 5/2022 | Caudle et al. | |

* cited by examiner

RIFLE COVER

FIELD

An exemplary embodiment relates to an apparatus for protecting the lower receiver of a rifle.

BACKGROUND

Customized items provide several benefits. Customizations make the item easier to recognize by the owner, can provide marketing to a business, and may provide better protection for the device and any personal information that may be displayed. Various rifle components may be customized. For example, different barrels, stocks, triggers, and other components can be replaced or modified. However, few of these provide a surface for displaying an icon or logo and will not protect personal information from being seen by the public. For example, serial numbers that are unique to each firearm are visibly engraved. As a result, this unique personal identifier is visible to the public.

The exposed portion of the lower receiver can be damaged by supports, concealments, dust/debris, and other elements that may impact the rifle. Damage to the lower receiver could alter or obliterate the displayed serial number, causing a violation of the law. Impacts from use on the lower receiver may also damage or wear the internal components of the rifle.

SUMMARY

According to at least one exemplary embodiment, a method, system and apparatus for customizing a rifle may be shown and described. An exemplary embodiment may include a cover which can be secured to the rifle. The cover may be placed over an area of the rifle which may contain personal information. For example, a cover may include a magnet that can magnetically attach to a metal firearm. In another exemplary embodiment, a cover may be formed from a strap that can wrap around a portion of a firearm. In an exemplary embodiment, the cover may surround the lower receiver of a firearm.

An exemplary embodiment may provide physical protection for the receiver housing. The lower receiver of a firearm may be used with a support and/or concealment device to increase accuracy. Supports and other attachments or added components may damage, scratch, or otherwise wear down the firearm. Impacts to the lower receiver may damage the internal components. Thus, an exemplary embodiment may protect the lower receiver from the aforementioned damage by covering the outer frame and absorbing any potential impacts.

Slings or other carrying methods may be attached to an exemplary embodiment. For example, the cover may include a hook, D-ring, loop, or other means for attaching a sling. Additional attachments to an exemplary embodiment may be contemplated. For example, an exemplary embodiment may be fitted with a push button for activated, for example, a laser, light, camera, or other function on or off the weapon system. The advantageous location of the cover may allow a user of the rifle to quickly and easily reach the push button or other component attached to an exemplary embodiment, since the cover along the lower receiver is advantageously positioned near the trigger of the rifle, where the user's hands may already be placed during normal operation. An exemplary embodiment may be painted, adhered, lasered, etched, or engraved with another design or identifier. For example, an embodiment may be used to advertise or market a brand by including a logo, trade name, or other marketing identifier.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

Figure 1A:
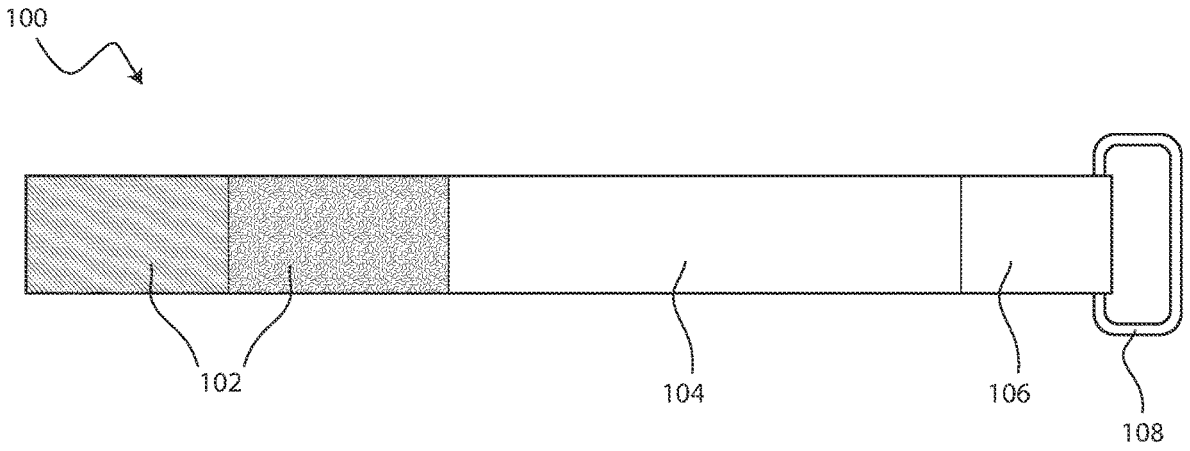
FIG. 1A is an exemplary embodiment of a cover formed from a strap.

An exemplary embodiment provides a cover for a rifle. FIG. 1A illustrates an exemplary cover 100. The cover 100 may include a strap that wraps around a portion of the rifle. For example, the cover 100 may wrap around the lower receiver of a rifle. The cover 100 may be designed to cover a portion of the rifle which displays personal information. In an exemplary embodiment, the cover may be designed to fit over the serial number of a rifle. The cover may include a band made of a material such as polyester.

A hook-and-loop connection 102 may tightly secure the cover around a portion of the rifle. The hook and corresponding loop may be embroidered onto the band 104. Other mechanisms for securing the band 104 may be contemplated, such as buckles and clasps 108 which can be tightened over the rifle.

Figure 1B:
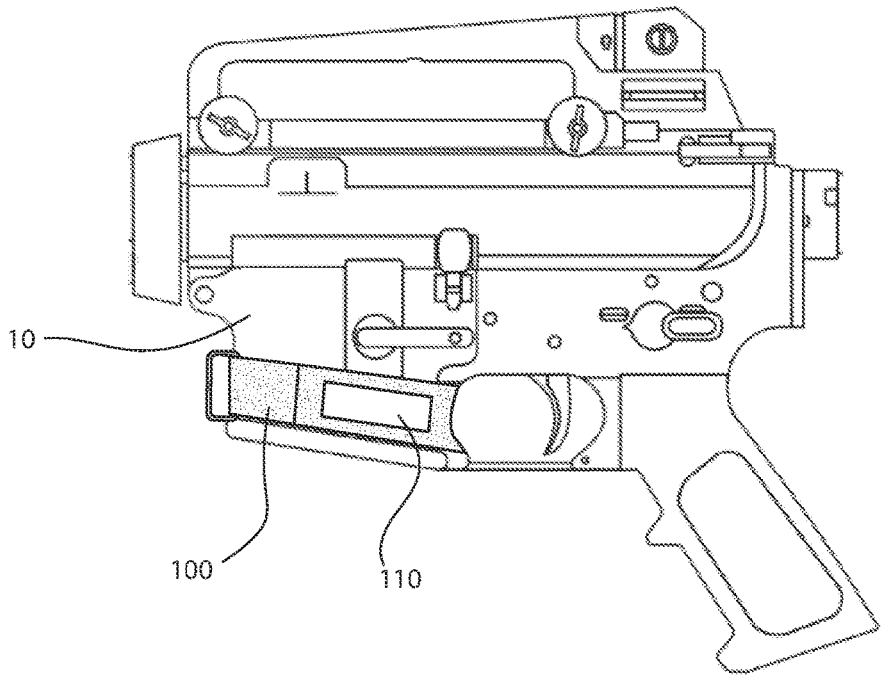
FIG. 1B is an exemplary embodiment of a cover formed from a strap attached to a rifle.

The band may also include an elastic portion 106. The elastic portion 106 may be connected to the polyester or band portion 104 and may allow for a more secure hold over the portion of the rifle. In some embodiments, the band portion may include silicon. The band 104 may be sized to secure around a portion of the rifle, such as the lower receiver. FIG. 1B may illustrate an exemplary embodiment fixed over the lower receiver 10 of a rifle. The embodiment illustrated in FIG. 1B may include a logo or other printed work 110 on the side of the band 104 of cover 100. The printed work 110 can be used to display a logo for advertising or marketing purposes or can be any other contemplated customization.

Figure 1C:
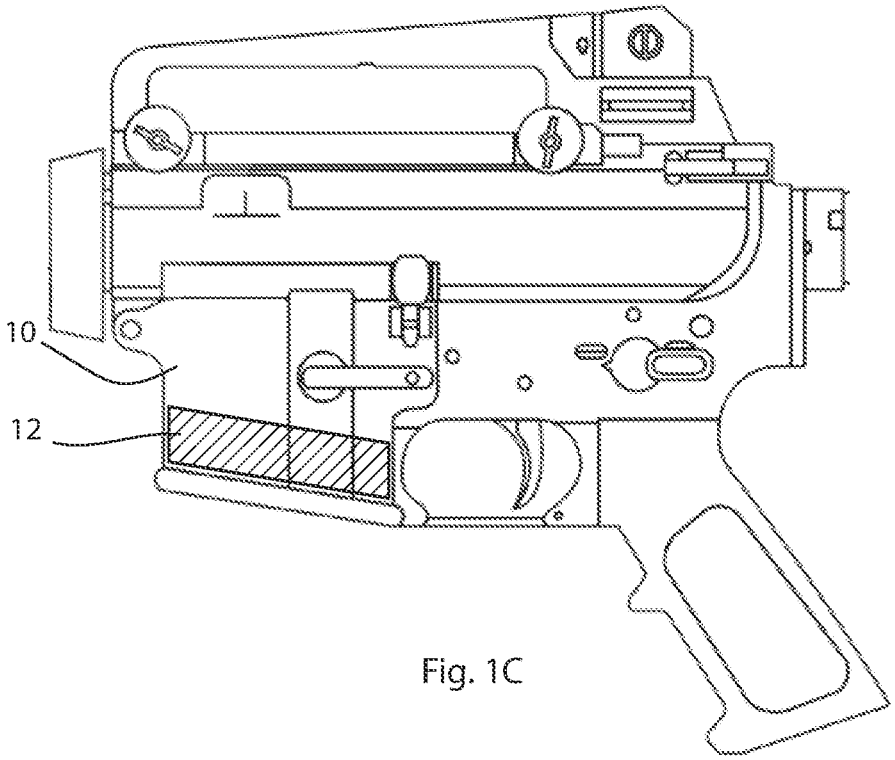
FIG. 1C is an exemplary embodiment of another cover attached to a rifle.

Referring now to FIG. 1C, FIG. 1C may illustrate an exemplary cover 12 fixed to the lower receiver 10 of a rifle. For example, the exemplary cover 12 may be fixed to the lower receiver 10 by means of an adhesive or a magnet. Thus, this exemplary cover may not need to wrap around the entire lower receiver and can instead cover a specific portion.

Figure 2:
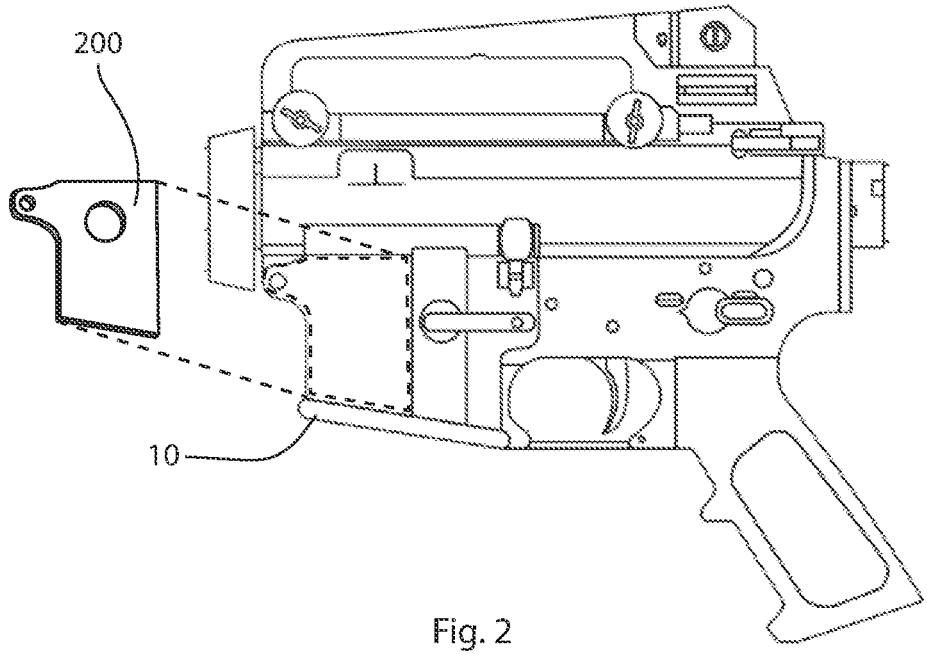
FIG. 2 is an exemplary embodiment of a cover configured to fit a portion of the lower receiver of a rifle.

FIG. 2 illustrates an exemplary embodiment of a cover designed to fit over a flat portion of the lower receiver 10. For example, rifles may include flat surfaces upon which model and serial numbers as well as manufacturer information is often printed or engraved. This may provide a flat surface ideal for affixing the cover 200 via a clip, magnet, or adhesive. The cover 200 may be sized to specifically fit a flat portion of the lower receiver 10, as shown in FIG. 2.

Slings or other carrying methods may be attached to an exemplary embodiment. For example, the cover may include a hook, D-ring, loop, or other means for attaching a sling. Additional attachments to an exemplary embodiment may be contemplated. For example, an exemplary embodiment may be fitted with a push button for activated, for example, a laser, light, camera, or other function on or off the weapon system. The advantageous location of the cover on the lower receiver may allow a user of the rifle to quickly and easily reach the push button or other component attached to an exemplary embodiment.

Figure 3A:
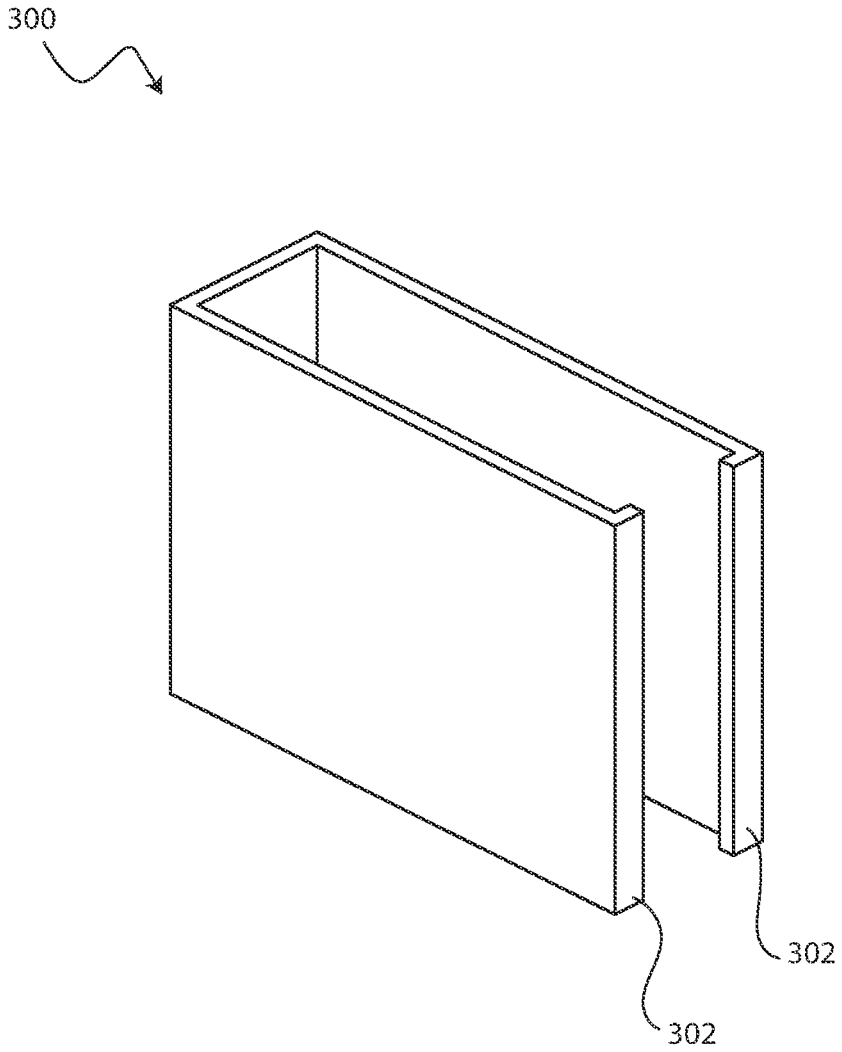
FIG. 3A is an isometric view of an exemplary cover.
Figure 3B:
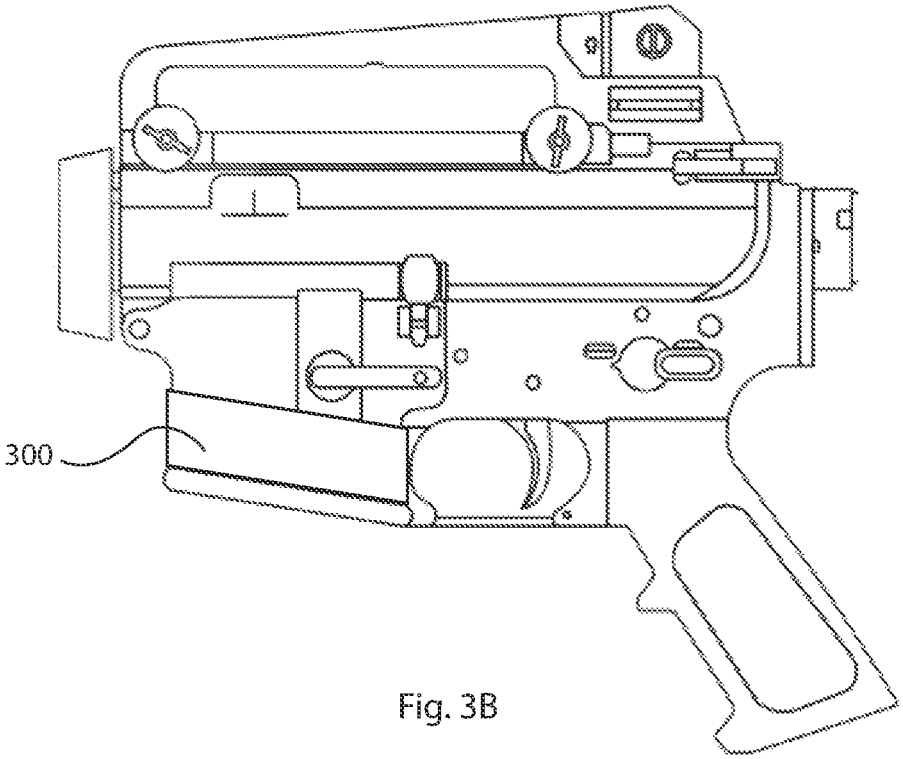
FIG. 3B is an exemplary embodiment of a cover clipped over the lower receiver of a rifle.
Figure 3C:
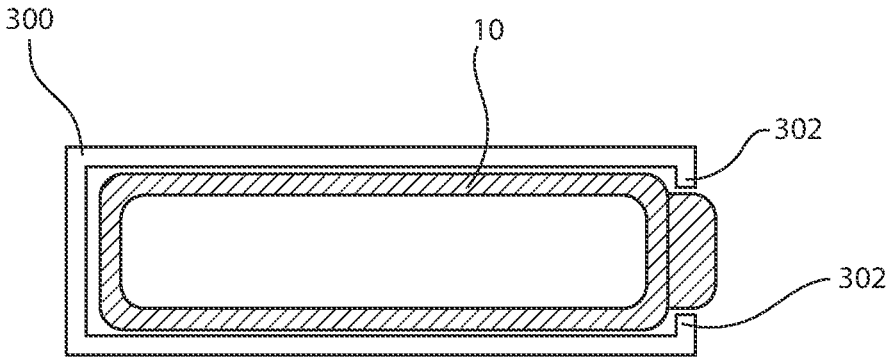
FIG. 3C is a bottom view of an exemplary embodiment.

FIG. 3A may illustrate an exemplary cover configured to snap over and clasp onto the lower receiver of a rifle. The cover 300 may include an opening with retainer clips 302 sized to snap over a portion of the lower receiver. For example, the retainer clips 302 may fit over the lower receiver and snap into the trigger guard of the rifle, in front of the trigger, as shown in the exemplary embodiment in FIG. 3B. The cover 300 may be formed of a rigid material such that the cover 300 does not flex and is tightly secured over the lower receiver 10. FIG. 3C may illustrate a bottom view of an exemplary embodiment. As shown in FIG. 3C, the cover 300 may fit over the lower receiver 10 and may include an open top and bottom to allow a magazine to be inserted into the rifle.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An apparatus for protecting a lower receiver of a rifle, comprising:

a first sidewall and a second sidewall separated by a backplate;

at least one clip provided on each of the first sidewall and the second sidewall at an opposite end of the first sidewall and second sidewall from the backplate, the at least one clip configured to fit over the lower receiver of the rifle and snap into a trigger guard of the rifle in front of a trigger of the rifle.

2. The apparatus for protecting the lower receiver of the rifle of claim 1, further comprising:

a magnet configured to magnetically attach the apparatus to the rifle.

3. The apparatus for protecting the lower receiver of the rifle of claim 1, further comprising:

an elastic band configured to wrap around the lower receiver.

4. The apparatus for protecting the lower receiver of the rifle of claim 1, wherein the first sidewall, the second sidewall, and the at least one clip are configured to form a mechanical spring to detachably couple the apparatus to the lower receiver.

5. The apparatus for protecting the lower receiver of the rifle of claim 1, wherein at least one of the first sidewall and the second sidewall further comprises:

a loop.

6. The apparatus for protecting the lower receiver of the rifle of claim 5, wherein the loop further comprises:

a sling configured to carry the rifle.

7. The apparatus for protecting the lower receiver of the rifle of claim 1, further comprising:

a button configured to activate an external component.

* * * * *